US006742368B1

(12) United States Patent
Wittwer et al.

(10) Patent No.: US 6,742,368 B1
(45) Date of Patent: Jun. 1, 2004

(54) CLOSING DEVICE FOR CLOSING FUNCTIONS IN VEHICLES IN PARTICULAR

(75) Inventors: Reinhard Wittwer, Heiligenhaus (DE); Mathias Löw, Ratingen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/149,258

(22) PCT Filed: Nov. 9, 2000

(86) PCT No.: PCT/EP00/11063

§ 371 (c)(1),
(2), (4) Date: Feb. 7, 2003

(87) PCT Pub. No.: WO01/42596

PCT Pub. Date: Jun. 14, 2001

(30) Foreign Application Priority Data

Dec. 10, 1999 (DE) ..... 199 59 833

(51) Int. Cl.[7] ..... E05B 17/04

(52) U.S. Cl. ..... 70/379 R; 70/380; 70/386; 70/419; 70/422

(58) Field of Search ..... 70/188–190, 222, 70/379 R, 379 A, 380, 386, 422, 472, 419

(56) References Cited

U.S. PATENT DOCUMENTS 4,056,955 A * 11/1977 Glass ..... 70/422
5,044,183 A * 9/1991 Neyret ..... 70/223
5,263,348 A * 11/1993 Wittwer ..... 70/379 R
5,640,864 A * 6/1997 Miyamoto ..... 70/379 R
6,058,751 A * 5/2000 Dimig et al. ..... 70/419
6,425,275 B1 * 7/2002 Geurden ..... 70/422
6,439,016 B1 * 8/2002 Wittwer et al. ..... 70/379 R

FOREIGN PATENT DOCUMENTS

| | | |
|---|---|---|
| DE | 0659962 | 6/1995 |
| DE | 196 39 251 C1 | 12/1997 |
| DE | 198 44 422 A1 | 6/1999 |
| EP | 0769598 | 4/1997 |

* cited by examiner

*Primary Examiner*—Lloyd A. Gall
(74) *Attorney, Agent, or Firm*—Friedrich Kueffner

(57) ABSTRACT

A closing device includes a cylinder core with followers and a closing cylinder with a freewheel sleeve and a housing accommodating the sleeve. Normally, a coupling slider is coupled to the cylinder core by a restoring force, but is decoupled therefrom in the event of overcharge. An axial connection is provided between the coupling slider and a locking and controlling member. The slider and the locking and controlling member can be radially moved, however, can be rotated between various rotational positions of the closing cylinder when the cylinder core is actuated using a key. The closing cylinder has two key removal positions. The coupling slider is displaced in the angle thereof by turning the key between at least two rotational positions which correspond to the key removal positions. The coupling slider can be radially displaced in the direction of the rotational positions. At least one locking and controlling member is allocated to each of the rotational positions.

17 Claims, 8 Drawing Sheets

CLOSING DEVICE FOR CLOSING FUNCTIONS IN VEHICLES IN PARTICULAR

BACKGROUND OF THE INVENTION

1. Field of the Invention

The invention pertains to a closing device for performing closing functions especially in motor vehicles.

2. Description of the Related Art

In comparison with similar closing devices of the older design (DE 44 12 609 A1), devices of this type (DE 198 53 543 A1, DE 197 49 329 C1) offer the advantage of being more compact in the axial direction.

The closing cylinder of these known devices (DE 198 53 543 A1, DE 197 49 329 C1) has only a single key withdrawal position, that is, only one position in which the key can be inserted freely into the cylinder core and pulled back out again. In DE 198-53,543 A1, for example, the key withdrawal position is in the starting position of the closing cylinder, which is determined for a defined rotational angle of the cylinder core by an impulse spring of the return spring. By rotating the key, the cylinder core can be moved to various other positions, which correspond to various other working positions of the working element.

In many practical applications, there is a need to be able to insert and withdraw the key in other rotational positions of the cylinder core. Thus, for example, in the case of the closing devices on the rear sliding or swinging doors or lids of motor vehicles, it is desirable to have the ability to pull the key out both in the starting position of the closing cylinder, i.e., when the lock is open, and also in a rotational position of the cylinder core characterizing the locked position of the lock. In the case of the known devices of the present type, it did not seem possible to realize this goal with an acceptable amount of effort.

SUMMARY OF THE INVENTION

The invention is based on the task of developing an inexpensive, reliable device of the type indicated in the introductory clause, which has at least two key-withdrawal positions rotationally offset from each other and which nevertheless have a compact design. This is accomplished according to the invention by the measures listed below, to which the following special meaning belongs:

In the normal case, the coupling slider is engaged with the cylinder core, so that, when the cylinder core is rotated by the turning of the key, the slider is carried along between one of the desired key withdrawal positions and at least one other key withdrawal position, thus arriving at one of the rotationally offset angles thus determined. In addition, several locking control elements are provided according to the invention, one of which is assigned to each of the rotational angles determining the various key withdrawal positions. On transition from the normal case to the overload case, the locking control elements move in the radial direction, as in the case of the devices of the type described in the introductory clause; this radial movement is transmitted to the coupling slider via an axial connection. In the invention, the radial movement of these rotationally offset radial elements occurs in the same direction as the associated rotational angle of the coupling slider when it is in one of the various key withdrawal positions. In the case of the device according to the invention, therefore, only a single coupling slider is needed, which, as a function of the selected key withdrawal position, cooperates with the locking control element or control elements assigned to it at the rotational angle in question, whereas none of the other locking elements participates in the overload case.

Additional measures and advantages of the invention can be derived from the following description, and especially from the drawings. The drawings illustrate the invention on the basis of a closing device unit comprising the closing cylinder, which is shown in various working positions:

DESCRIPTION OF THE PREFERRED EMBODIMENTS

In the invention, two key withdrawal positions 45, 46 are provided, which usually have a rotational offset 49 of 90° from each other. For this purpose, the invention uses at least two locking control elements, which are designed here as rollers 21, 22. These rollers 21, 22 must be positioned so that they move in the same direction as that in which a coupling slider 30 moves when it couples. When force is applied, which is characteristic of the overload case (FIG. 9, FIG.

Figure 11:
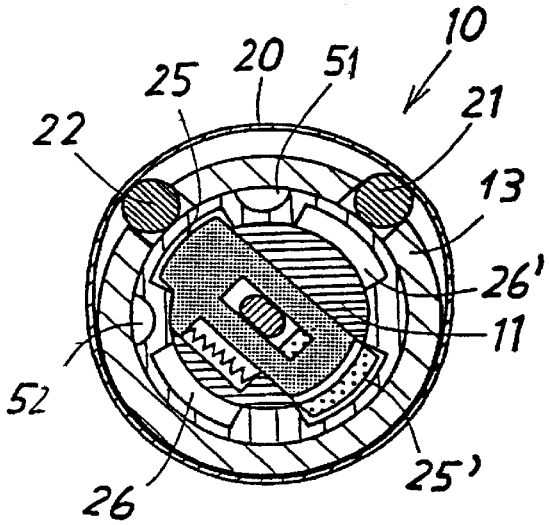
Figure 12:
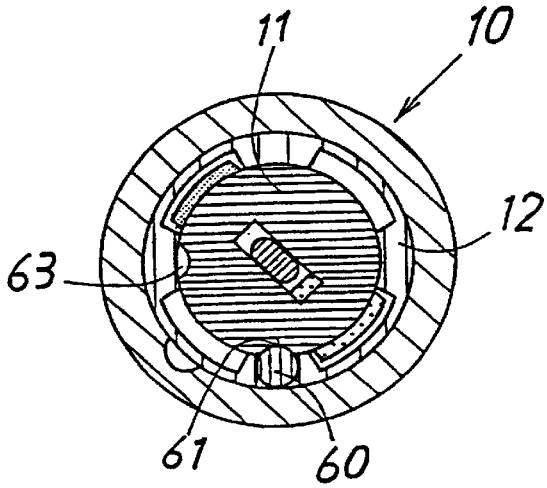
Figure 13:
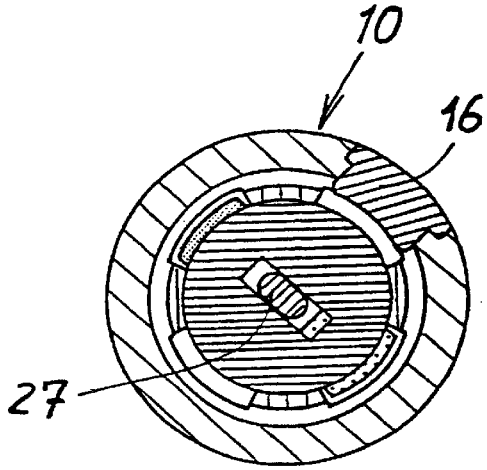
Figure 14:
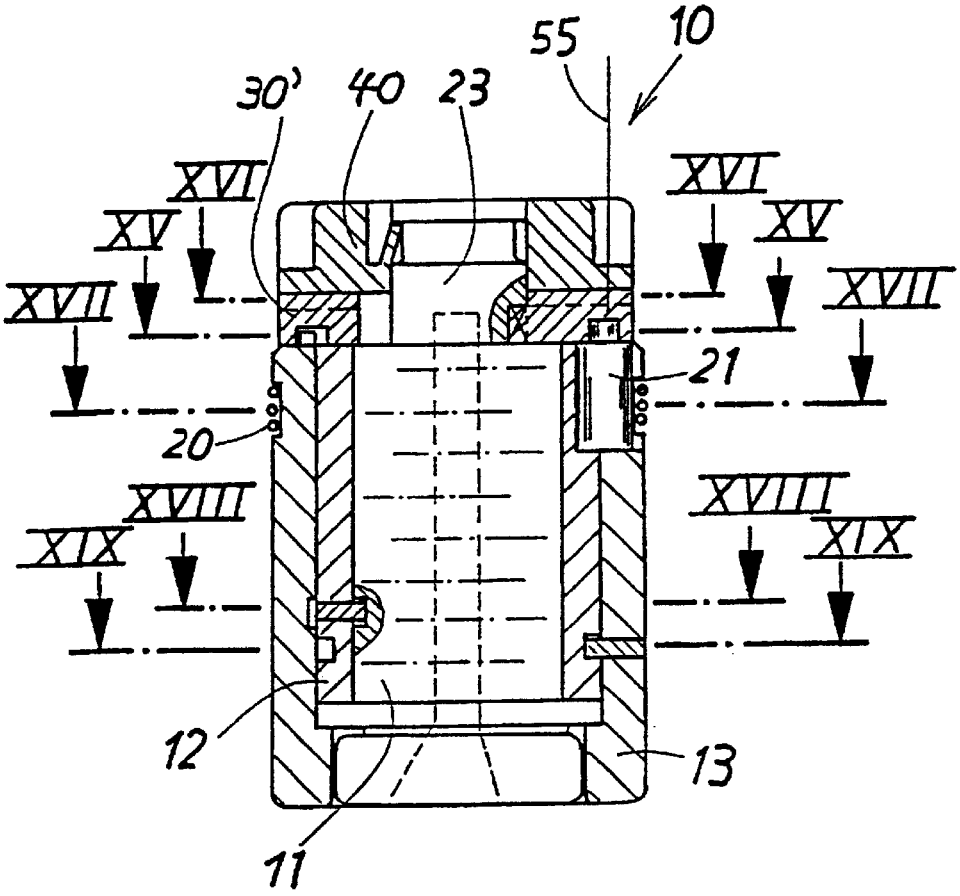
FIG. 14 shows a partial axial cross section of the unit, similar to FIG. 1, in which a second key withdrawal position is present and the rotating parts are now at a different angle, determined by this second withdrawal position.
Figure 23:
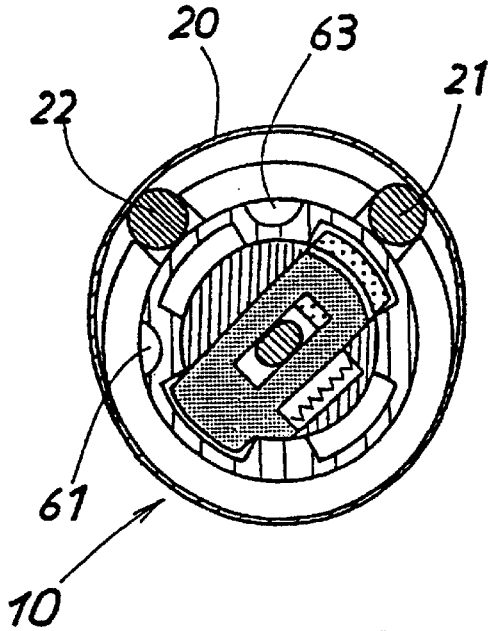

21), one of the rollers 21, 22 takes over the job of transporting the coupling slider 30, while the other roller 22, 21 does nothing. Both rollers 21, 22, however, always participate in the unlocking moment which allows the freewheel sleeve 12 to freewheel (FIGS. 11, 23).

Figure 1:
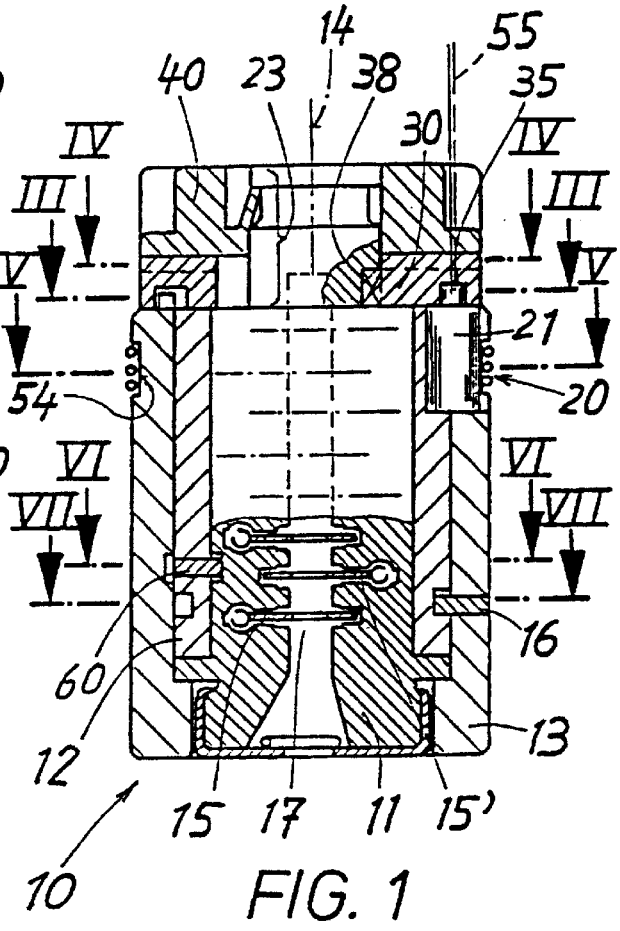
FIG. 1 shows a longitudinal section through the closing cylinder unit according to the invention in a first key withdrawal position characterizing the starting position, where, for reasons of clarity, the components in this longitudinal section are rotated in comparison with the cross section of the following figures.
Figure 4:
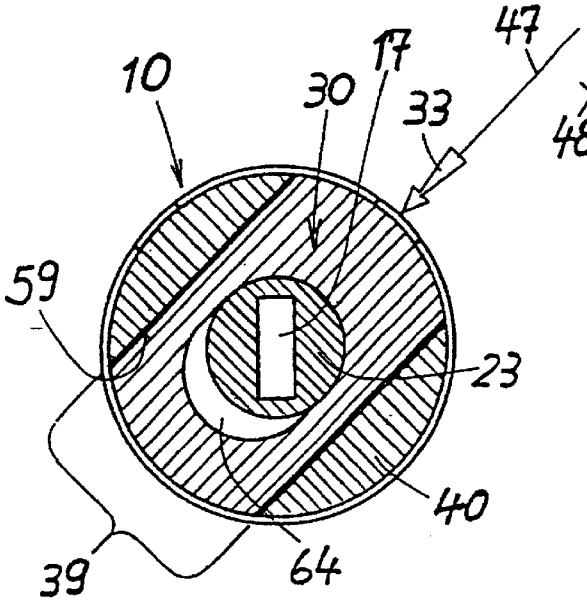
Figure 5:
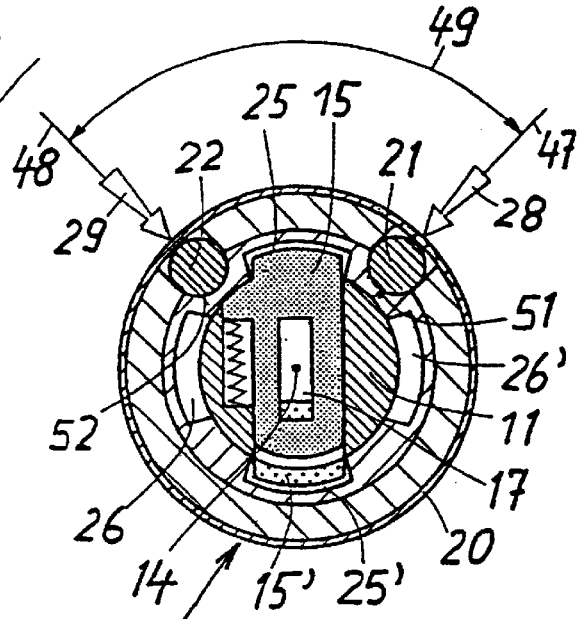

The closing device shown in FIGS. 1–25 is especially suitable for use in the doors of vehicles. The closing cylinder 10 consists, first, of a free-wheel sleeve 12 and a cylinder core 11, supported in the cylinder with freedom of rotation but not of axial movement. The axially-immovable connection is produced by the contact between shoulder surfaces of the two components. The cylinder core 11 holds spring-loaded tumblers 15, 15' and has an axial extension 23 and a key channel 17 for accepting a key (not shown). Once the key has been withdrawn, the springs acting on the tumblers 15, 15' push them radially outward so that they engage in locking channels 25, 25' as shown at 15, 15' in FIG. 5. Then the cylinder core 11 is locked to the freewheel sleeve 12. Because of the space required to accommodate the springs, the tumblers 15, 15' are preferably designed to move in opposite directions, as indicated in FIG. 1. The tumbler 15 thus engages in the locking channel 25, and the adjacent tumbler 15' engages in the locking channel 25' (FIG. 5).

Figure 9:
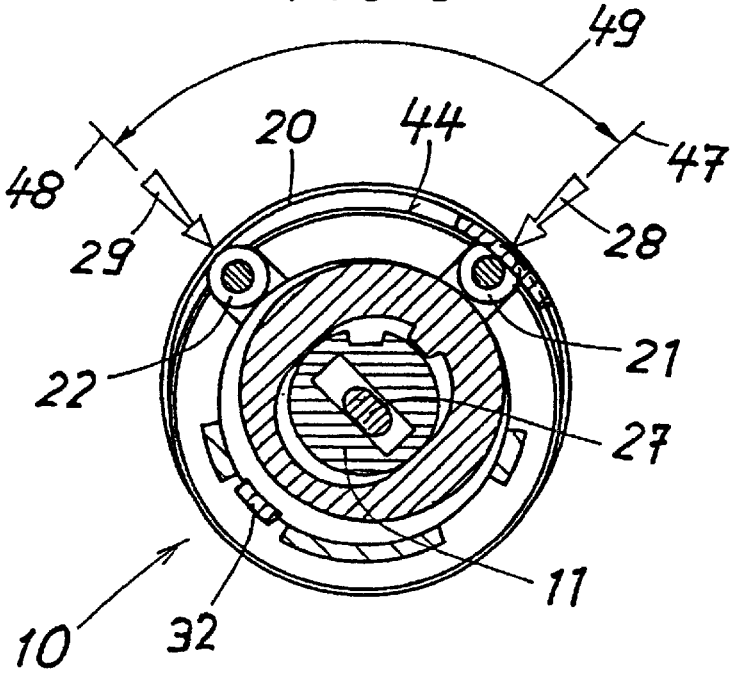
FIGS. 9–13, in analogy to FIGS. 3–7, show various cross-sectional views of the operating case shown in FIG. 8, where, as a result of forcible rotation by a picking tool suggested in the cross section, the cylinder core has been rotated toward the left by about 45° relative to the starting position, the locations of the cross sections being indicated by the lines IX—IX, X—X, XI—XI, XII—XII, and XIII—XIII in FIG. 8.

The freewheel sleeve 12 is supported with freedom to rotate in a stationary, cylindrical housing 13. An assembly aid 16 passes through a certain part of the housing 13 and fits into a circumferential groove in the freewheel sleeve 12. In the normal case (FIGS. 1–7), however, the freewheel sleeve 12 is prevented from rotating freely by two locking control elements, which are designed here as rollers 21, 22. A one-piece annular spring 20 surrounds both of these two rollers 21, 22, as a result of which a spring-loading force 28, 29 is produced, which is directed toward the axis 14. The turns 58 of the annular spring 20 are held in a circumferential groove 54 in the housing 13. In the normal case 55, the turns 58 remain within the circumferential area 44 of the housing 13. In the case of an unauthorized intervention, the annular spring 20 is pushed out of the circumferential area 44 of the housing 13 by the movement of the rollers 21, 22 (FIG. 9).

FIGS. 1–7 show the normal case 55 of the closing cylinder 10 in the vertical key withdrawal position 45. In this withdrawal position 45, a properly fitting key can be inserted into the key channel 17 and pulled back out again. This is also true in FIGS. 14–19, which show the horizontal key removal position 46, which therefore does not require any further discussion.

When the key is inserted, the tumblers 15, 15' (not shown here) are sorted on the circumference of the cylinder core 11. The cylinder core 11 is now free to rotate in the freewheel sleeve 12 around the axis 14. A working element 40, which consists here of a gear wheel, is mounted on the axial extension 23 of the cylinder core 11.

Figure 2:
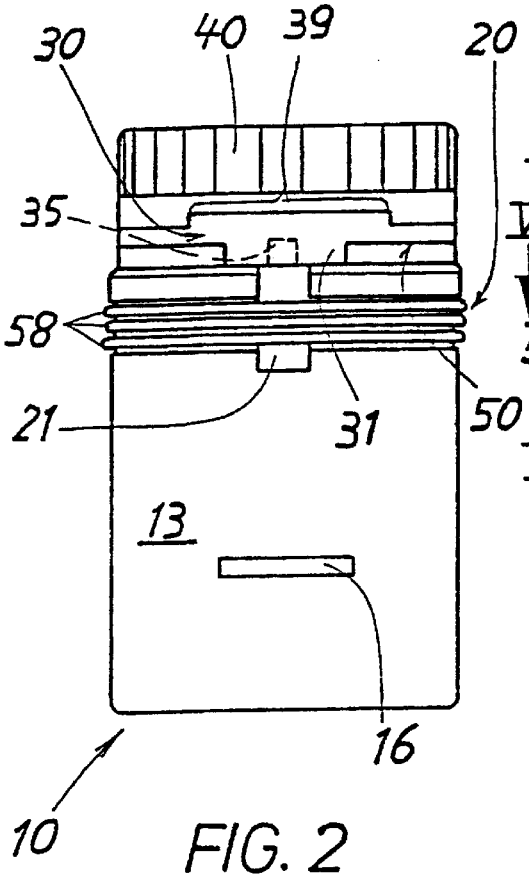
FIG. 2 shows a side view of the unit shown in FIG. 1, that is, in a cross-sectional plane perpendicular to that of FIG. 1, in this same starting position.
Figure 22:
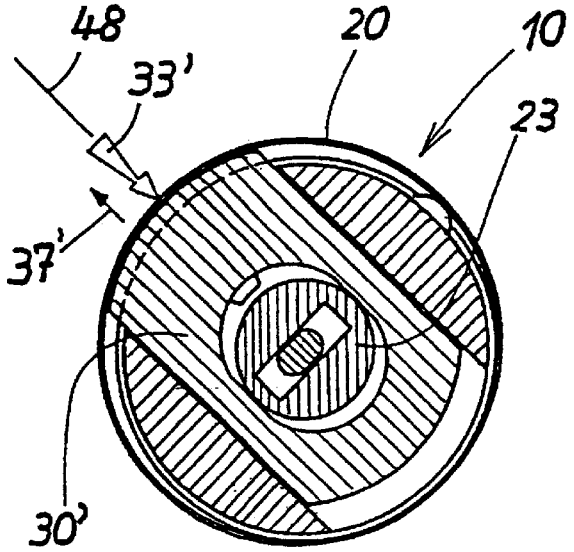

When the key is turned, the cylinder core 11 can be moved to various rotational positions 47, 48, which correspond to certain working positions of the gear wheel 40 and of the lock in engagement with it. This rotation of the cylinder core 11 is transmitted in the following way to the gear wheel. The previously mentioned coupling slider 30 is located between the working element 40, the end surface of the freewheel sleeve 12, and the housing 13. In the bottom of the working element 40, a diametric channel 39 is provided, which serves to guide the coupling slider 30 radially (FIGS. 2 and 4). For this purpose, the plate of the coupling slider 30 has a suitable outline 59. Because of the way the working element 40 and the coupling slider 30 fit together, they are unable to rotate relative to each other. The coupling slider 30 is subjected to a force acting in the direction of the arrow 33 in FIG. 4. The same is also true in the rotational position 48 of the slider 30' in FIG. 22, illustrated by the arrow 33'. Thus the coupling elements 18, 38 shown in FIG. 3 engage with each other. The coupling projection 38, belonging to the coupling slider 30 and located on the circular central shoulder 34, engages in the radial recess 18 in the axial extension 23 of the cylinder core 11. When the key causes the cylinder core 11 to rotate, the engagement between 18 and 38 and the radial guidance of the coupling slider 30 in the channel 39 allow the working element 40 to be rotated by the cylinder core 11, which thus allows the lock components to perform the desired closing function.

The end surface 50 of the coupling slider 30 is also equipped with a first and a second segment 31, 32, and the end surface 19 of the housing 13 is equipped with opposing segments 43. These segments determine between them a first and a second segment gap 41, 42. These segments and gaps are placed in such a way that, in the overload case with the working element 40 disconnected, the coupling slider 30 is locked to the housing 13. This situation is shown for the two key withdrawal positions 45, 46 in FIG. 9 and in FIG. 21.

Figure 3:
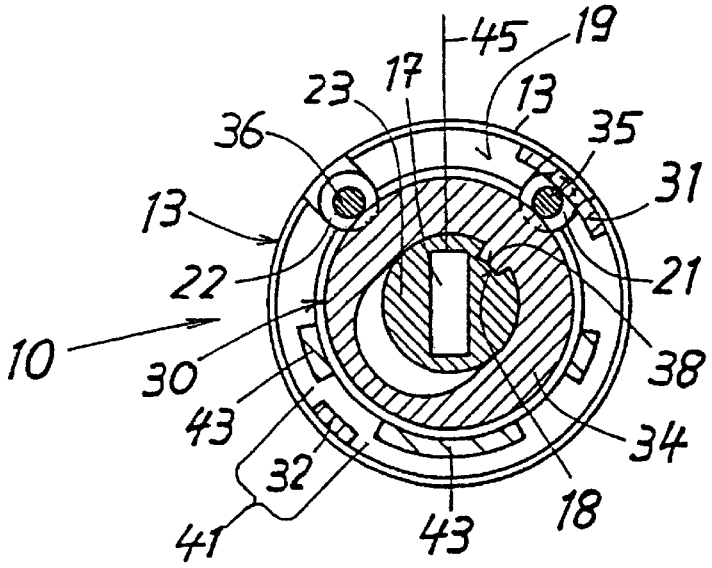
FIGS. 3–7 show various cross-sectional views through the unit shown in FIG. 1 in the starting position, these cross sections being taken along the lines III—III, IV—IV, V—V, VI—VI, and VII—VII of FIG. 1.
Figure 15:
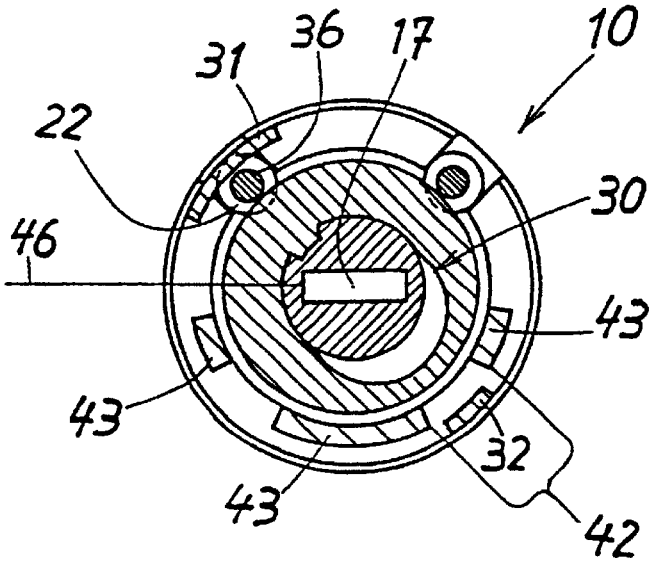
FIGS. 15–19, in analogy to FIGS. 3–7, show cross sections through the unit in the second key withdrawal position of FIG. 14, the cross sections being taken along the lines XV—XV, XVI—XVI, XVII—XVII, XVIII—XVIII, and XIX—XIX in FIG. 14.
Figure 16:
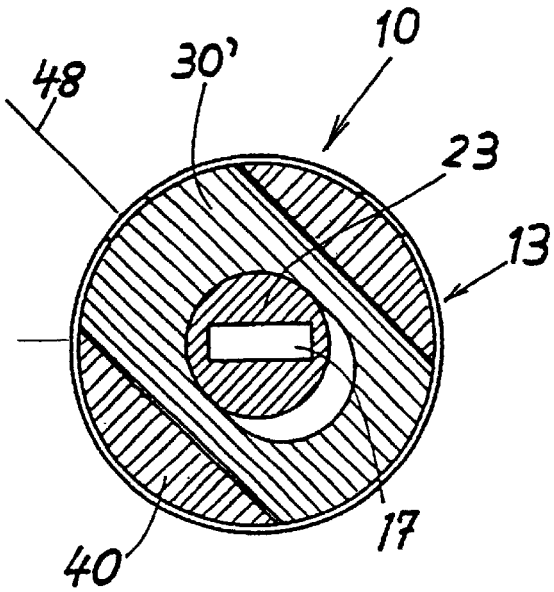
Figure 17:
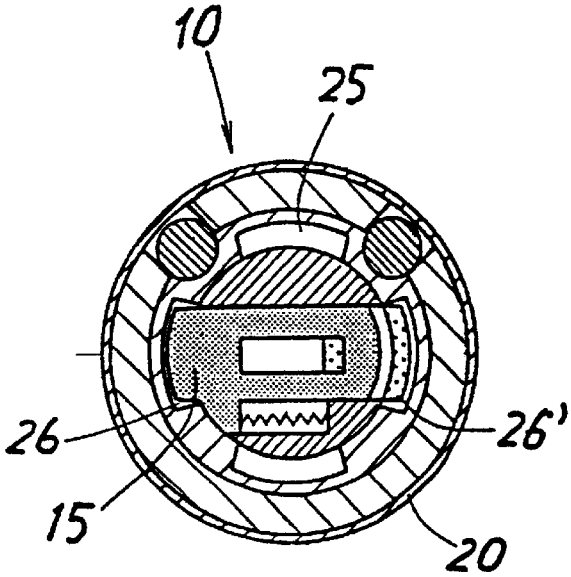
Figure 18:
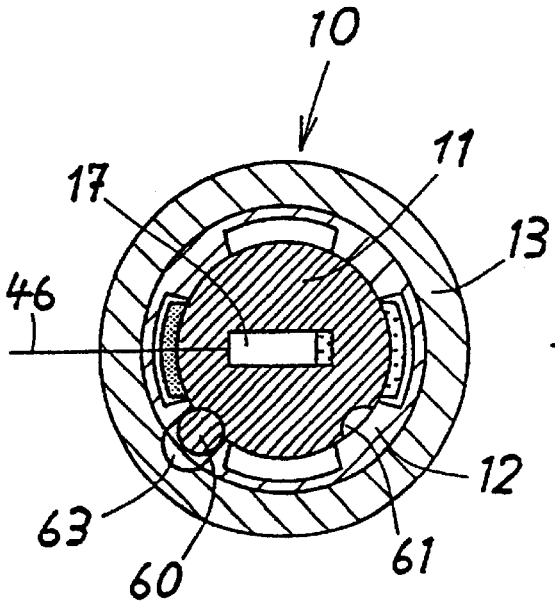
Figure 19:
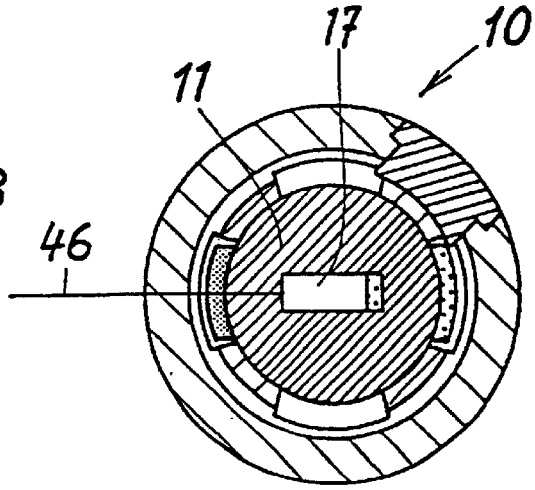
Figure 20:
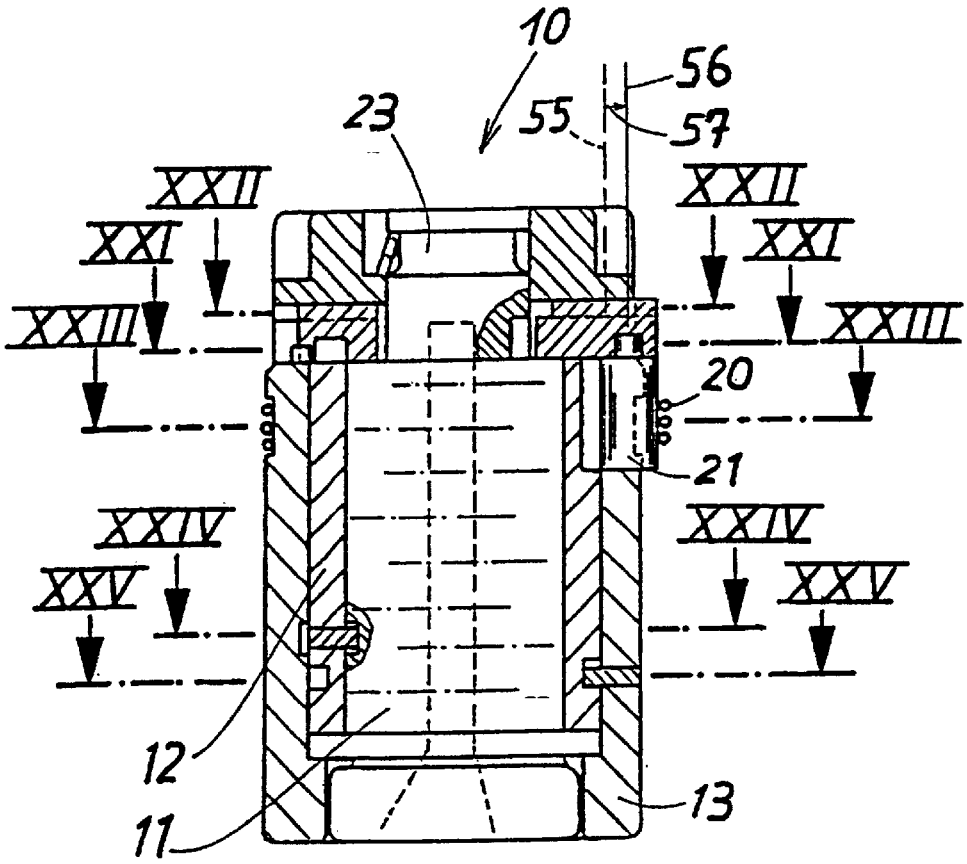
FIG. 20 again shows the overload case of the closing cylinder, but here the unit is in the second key withdrawal position according to FIGS. 14–19, and the rotating components have been forcibly turned by a picking tool, suggested in the cross section, by about 45° to the left.
Figure 21:
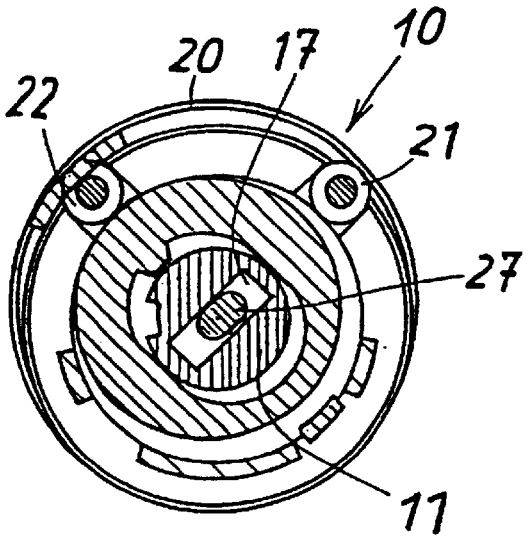
FIGS. 21–25, finally, in analogy to FIGS. 3–7, show five cross sections-along the cross-sectional lines indicated there, namely, lines XXI—XXI, XXII—XXII, XXIII—XXIII, XXIV—XXIV, and XXV—XXV, from which the relationships resulting in this case can be derived.

The segments 31, 32, the opposing segments 43, and the segment gaps 41, 42 also fulfill a radial retention function for the coupling slider 30 during the rotation of the cylinder core 11 between the two key withdrawal positions, as can also be derived from FIG. 3 and FIG. 15 in the two key withdrawal positions 45, 46. Before the first segment 31 of the coupling slider 30 leaves the axial shoulder 35 of the roller 21, which functions as a connecting point, a diametrically opposing second segment 32 arrives in an intermediate position outside the segment gap 41. As the slider continues to turn, it is then guided by one of the three opposing segments 43 provided. This continues until the end position shown in FIG. 15 is reached. Then the first segment 31 of the coupling slider 30 is located at the axial shoulder 36 of the second locking control element 22. This position of the coupling slider is designated by the number 30' in FIGS. 14–25. In this second key withdrawal position 46, shown in FIGS. 14–19, the second segment 32 of the coupling slider 30' is aligned with the second segment gap 42 created by the three provided opposing segments 43.

The overload case 56 of the closing device is shown in FIGS. 8–13 and FIGS. 20–25. A lock-picking tool 27 acting on the cylinder core 11 has been used forcibly to rotate the cylinder core 11. In this case, the tumblers 15, 15' are in locking engagement with the freewheel sleeve 12, as shown in FIGS. 11 and 23. As a result of this forcible rotation, therefore, the freewheel sleeve 12 is carried along with the cylinder core 11. Between the slanted sides of the rollers 21, 22 on the one hand and the radial recesses 51, 52 on the other, there arises an axial force opposing the spring-loading 28, 29, which lifts the rollers 21, 22 out of the stationary recesses 51, 52 in the freewheel sleeve 12. The freewheel sleeve 12 continues to rotate within the housing 13, so that the rollers 21, 22 are now supported on the outside surface of the freewheel sleeve 12 (FIG. 11), over which they slide as the forcible rotation continues. As a result of this process, the rollers 21, 22 are pushed toward the outside by the distance indicated by the motion arrow 57 in FIG. 8. The annular spring 20 enclosing the rollers 21, 22 extends beyond the circumferential area 44 of the housing 13, as can be seen in FIG. 9.

Figure 8:
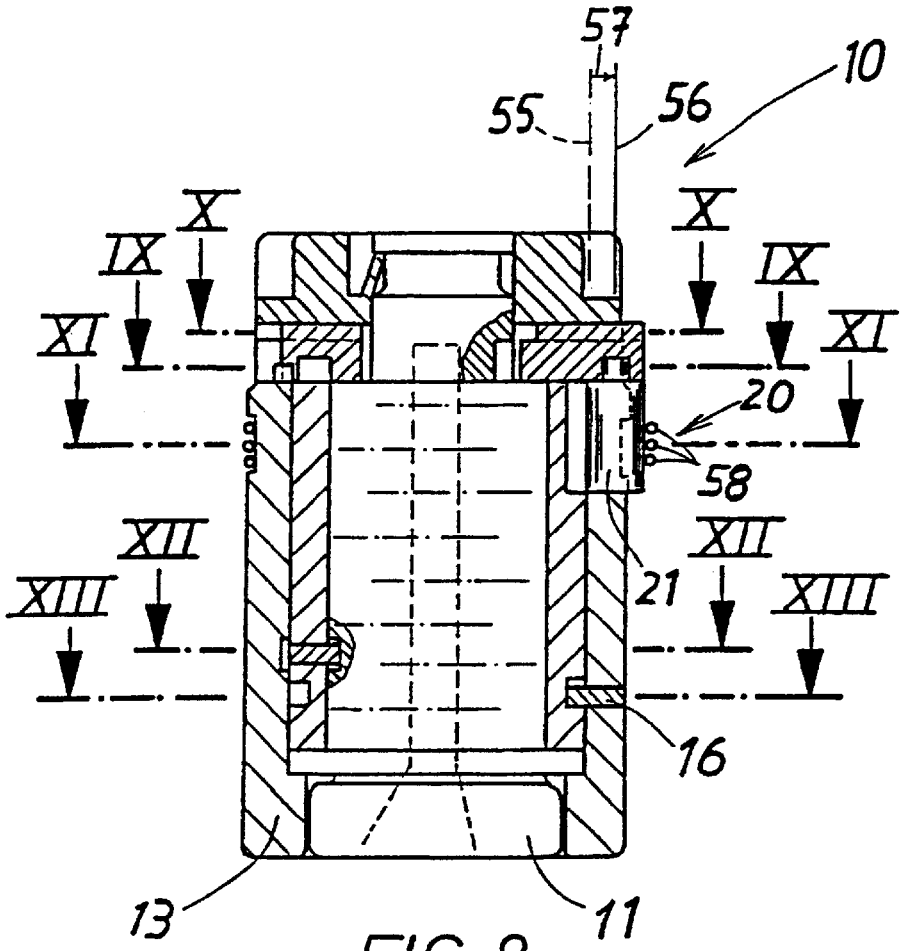
FIG. 8 shows an axial cross section, similar to FIG. 1, of the unit in the overload case, the components being in the positions which correspond to the starting position of the cylinder core.
Figure 10:
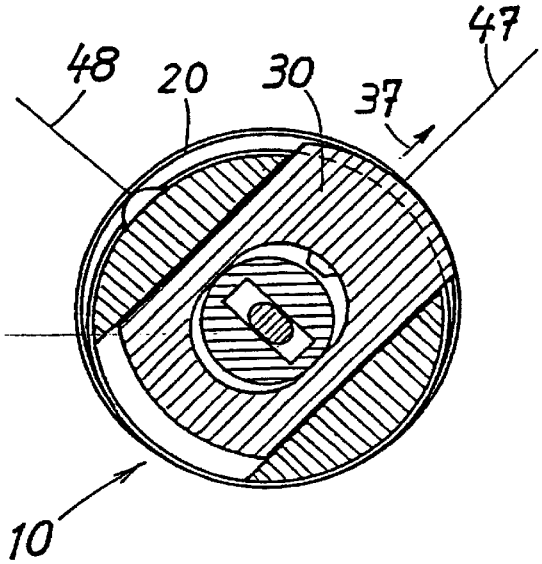

The coupling slider 30 is also carried along by this same distance 57 by the shoulder 35 of the roller 21 or by the shoulder 36 of the roller 22 and thus arrives in the axially offset thrust position illustrated by the auxiliary line 56 in FIG. 8. The displacement paths 37, 37' of the coupling element 30 are illustrated in FIGS. 10 and 22. It can be seen from FIGS. 9 and 10 that the forced movement of the coupling slider 30 along the displacement path 37 leads to the situation in which the axial extension 23 of the cylinder core 11 is now in a new position in the slot 64 in the coupling slider 30. In this position, as can be seen in FIG. 9, the coupling projection 38 of the coupling slider 30 is no longer engaged in the recess 18 in the axial extension 23 of the cylinder core 11. The forcible rotation of the cylinder core 11 is not transmitted to the coupling slider 30 and thus not to the working element 40.

For the sake of a compact design, it is highly advantageous for the two locking recesses 51, 52 in the freewheel sleeve 12 for the two rollers 21, 22 to be located between the two pairs of tumbler channels 25, 25' and 26, 26' also provided there, as can best be seen in FIG. 11. The pairwise arrangement of these tumbler channels 25–26' is necessary to accommodate the opposite directions in which the tumblers 15, 15' move to arrive in their locking positions after the key has been withdrawn, as shown for the two normal cases according to FIGS. 5 and 17. These tumblers 15, 15', for the sake of clarity, have been illustrated by the fine and coarse shading in the figures. The first pair of tumbler channels 25, 25' is active in the key withdrawal position of FIGS. 1–13, characterizing the starting position, whereas the other pair of tumbler channels 26, 26', locks the cylinder core in the second key withdrawal position according to FIGS. 14–25.

Figure 6:
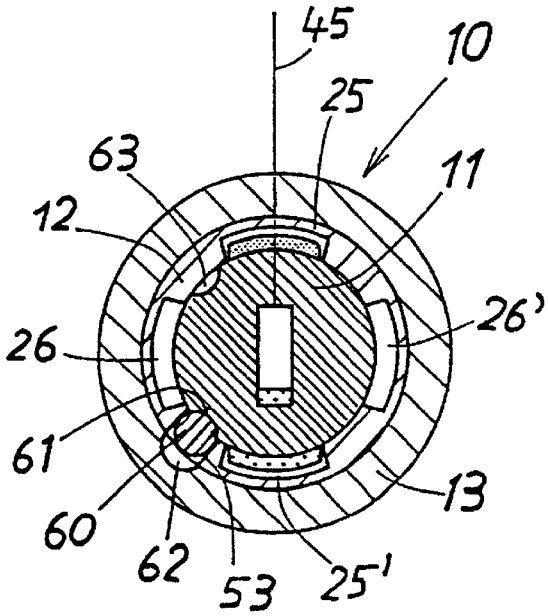
Figure 7:
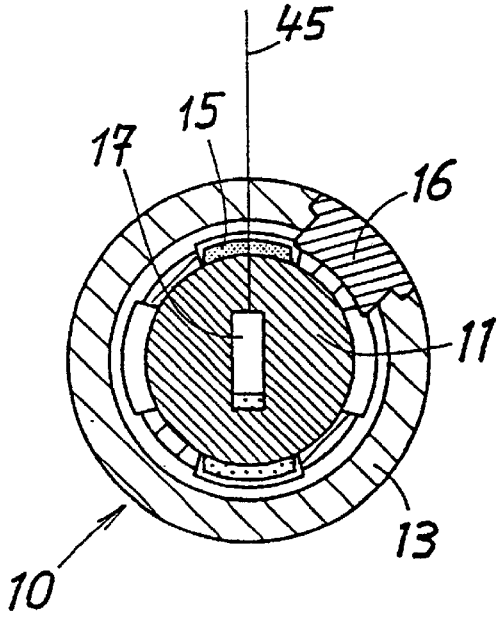
Figure 24:
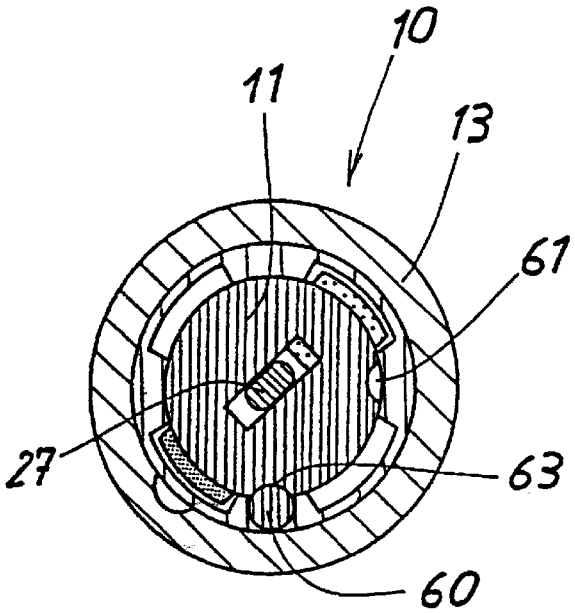
Figure 25:
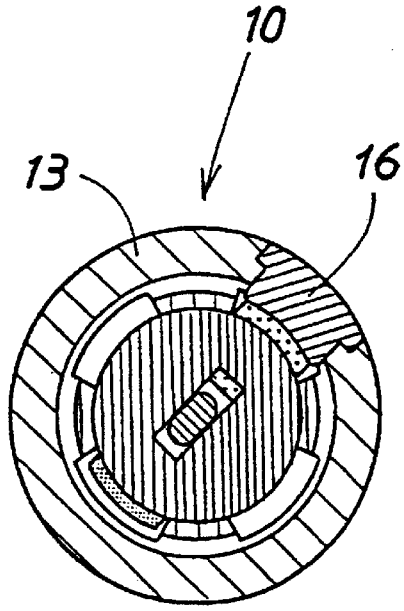

As can be seen in FIG. 6, a retaining element 60 is provided in a radial bore 53 in the freewheel sleeve 12 between the tumbler channels 26 and 25'. A recess 62 on the inside wall of the housing 13 and two opposing recesses 61, 63 on the circumferential surface of the cylinder core 11 are assigned to this radial bore 53, into which recesses the retaining element 60, designed here as a disk, can alternately escape upon transitions between the normal case and the overload case. The one opposing recess 61 is active when the overload case occurs in the starting key withdrawal position 45 according to FIG. 12, whereas the other opposing recess 63 performs its locking function in the other key withdrawal position 46 of the unit, as shown in FIG. 24.

FIGS. 8–13 show the use of a lock-picking tool 27 in the key channel 17 during the overload case starting from the key withdrawal position 45, whereas FIGS. 20–25 show the analogous situation starting from the key withdrawal position 46. By the exertion of force, the cylinder core 11 can be turned along with the freewheel sleeve 12 into any desired position. Upon insertion of the correct key, not shown in detail in the figures, the tumblers 15, 15' are disengaged from the freewheel sleeve 12. The freewheel sleeve 12 remains connected to the cylinder core 11 by the retaining element 60, however, until the turning of the key has brought the core back to one of the starting positions, i.e., either the position according to FIG. 6 or the position according to FIG. 18. It is for this reason that the two opposing recesses 61, 63 are provided.

As the retaining element 60, it is also possible to use a slider or a pin instead of the disk mentioned above. The retaining element 60 is under the positive control of the cylinder core 11, the freewheel sleeve 12, and the housing 13. There is therefore no need to install a spring or the like on the retaining element 60. In the normal case, the freewheel sleeve 12 and the housing 13 automatically form a connection with each other, whereas, in the freewheeling case produced by the use of force, the cylinder core 11 and the freewheel sleeve 12 automatically form a connection with each other. These connections are formed when the system is turned from the key withdrawal positions 45, 46. It is only in the two key withdrawal positions 45, 46 that there no need for any of the three parts 11–13 to be connected to each other. The normal case is illustrated by the auxiliary line 55 for the roller 21 in FIG. 1, and the freewheeling case is illustrated by the auxiliary line 56 in FIG. 8.

LIST OF REFERENCE NUMBERS

10 closing cylinder
11 cylinder core
12 freewheel sleeve
13 housing
14 axis of 10 or 11
15,15' tumbler
16 assembly aid between 13, 12
17 key channel in 11
18 coupling recess for 38 in 11 (FIG. 3)
19 end surface of 13 (FIG. 3)
20 spring means, annular spring, helical spring
21 first locking control element, roller
22 second locking control element, roller
23 axial extension of 11 (FIG. 1)
24
25, 25' tumbler channel in 12 for 15, 15' at 45 (FIGS. 1–13)
26, 26' tumbler channel in 12 for 15, 15' at 46 (FIGS. 14–25)
27 lock-picking tool
28 arrow of the spring loading of 21 (FIG. 5)
29 arrow of the radial spring loading of 22 (FIG. 5)
30 coupling slider (first rotational position, FIG. 4)
30' second rotational position of 30 (FIG. 16)
31 first segment on 19 of 13 (FIG. 3)
32 second segment on 19 of 13 (FIG. 3)
33 restoring force on 30 (first rotational position, FIG. 4)
33' restoring force on 30' (second rotational position, FIG. 22)
34 circular central shoulder of 30
35 axial connection between 30, 21, axial shoulder
36 axial connection between 22, 30, axial shoulder
37 displacement path of 30 at 47 (FIG. 10)
37 ' displacement path of 30 at 48 (FIG. 10)
38 coupling projection on 30 for 18
39 radial guide for 30, diametric channel in 40
40 working element, gear wheel
41 first segment gap between 43 for 32 at 45 (FIG. 3)
42 second segment gap for 32 at 46 (FIG. 15)
43 opposing segment, guide surface for 41, 42
44 circumferential area of 13 (FIG. 9)
45 auxiliary line for the first key withdrawal position (FIG. 3)
46 auxiliary line for the second key withdrawal position (FIG. 15)
47 rotational position of 30 at 45
48 rotational position of 30' at 46
49 angular shift between 30, 30', angular offset between 21, 22 (FIG. (9)
50 end surface of 30
51 radial recess in 12 for 21
52 radial recess in 12 for 22
53 radial bore in 13 for 60
54 circumferential groove in 44 for 20
55 auxiliary line for the normal case of 21
56 auxiliary line for the overload case of 21
57 radial movement of 21 between 55, 56 (FIG. 8)
58 turn of 20
59 plate outline of 30 (FIG. 4)
60 retaining element, disk
61 first opposing recess in 11 for 60 at 45 (FIG. 6)
62 recess in 13 for 60 (FIG. 6)
63 opposing recess in 11 for 60 at 46 (FIG. 18)
64 slot in 30 (FIG. 4)

What is claimed is:

1. Closing device for performing closing functions especially in motor vehicles, with a closing cylinder (10), which comprises a freewheel sleeve (12) and a cylinder core (11) with tumblers (15, 15'), the core being supported in the sleeve with freedom of rotation;

where the tumblers (15, 15') can be controlled by an insertable key but lock the cylinder core (11) to the freewheel sleeve (12) after the key has been removed;

with a stationary housing (13), in which the freewheel sleeve (12) is held with freedom of rotation and in which the freewheel sleeve (12) is prevented in the normal case (55) from rotating (51, 52) by radially spring-loaded (28, 29) locking control elements (21, 22), but is released by the locking control elements (21, 22) in the overload case (56);

with a working element (40), which performs the closing function in the motor vehicle; and with a coupling slider (30), which is prevented from rotating with respect to the working element (40) but which is free to slide radially (37), which slider is connected (51; 52) to the cylinder core (11) by a restoring force (33; 33') in the normal case but is disconnected from it in the overload case;

where an axial connection (35; 36) allows the coupling slider (30; 30') to move in the radial direction (57; 37; 37') together with the locking control element (21; 22), but where the slider is free to rotate between various rotational positions of the closing cylinder (10) when the cylinder core (11) is turned by a key; and where the spring-loading (28; 29) of the locking control element simultaneously produces the restoring force (33; 33') acting on the coupling slider (30), wherein the closing cylinder (10) has at least two key removal positions (45; 46) rotationally offset (49) from each other, in which the key can be freely inserted into the cylinder core (10) and pulled back out again, and in each of which positions the freewheel sleeve (12) has locking means (25 or 26') for the tumblers (15, 15'); wherein the angular position (49) of the coupling slider (30, 30') can be changed by rotation of the cylinder core (11) back and forth between at least two rotational angles (47; 48) determined by the key removal positions (45; 46), the slider also being free to move radially in the direction of each of these rotational angles (47; 48); wherein several locking control elements are provided, at least one of which is assigned to each of the rotational angles (47; 48) determining the key removal positions (45, 46); and wherein the radial movement (57) of the rotationally offset (49) locking control elements (21; 22) which occurs on the transition between the normal case (55) and the overload case (56) occurs in the same direction as the associated rotational angle (47; 48) of the coupling slider (30; 30').

2. Device according to claim 1, wherein segments (31; 32) and opposing segments (43) with segments gaps (41; 42) are provided between the coupling slider (30; 30') and the housing (13); and wherein the segments (31; 32) and the segment gaps (41; 42) are aligned with each other in groups at the various rotational angles (47; 48) determining the key withdrawal positions (45; 46).

3. Device according to claim 2, wherein the coupling slider (30) is provided in a section of the cylinder core (11) adjacent to the section of the cylinder core (11) which holds the tumblers (15, 15'); and wherein the segments (31; 32), opposing segments (43), and segment gaps (41; 42) are arranged on the facing end surfaces (50; 19) of the coupling slider (30) and of the housing (13).

4. Device according to claim 1, wherein the various restoring forces (33; 33'), which act on the individual rotationally offset (49) locking control elements (21; 22) are themselves rotationally offset (49) from each other in correspondence with the rotational angles (47; 48) characterizing the key withdrawal positions (45; 46).

5. Device according to claim 4, wherein the restoring forces (33; 33') acting in the various rotational angles are always acting in the radial direction relative to the axis (14) of the closing cylinder (11); and wherein the spring means (20) serving to produce these restoring forces (28; 29) are arranged in the circumferential area (44) of the housing (13).

6. Device according to claim 5, wherein the spring means for the various locking control elements (21, 22) consist of a single annular spring (20), which surrounds at least certain areas of the circumference (44) of the housing (13).

7. Device according to claim 6, wherein the annular spring (20) consists of a helix with several turns (58), which are in themselves elastic in the radial direction.

8. Device according to claim 7, wherein the helical spring (20) is held in a circumferential groove (54) in the cylindrical housing (13).

9. Device according to claim 1 wherein the working element (40) is rotatably supported coaxially (14) on the cylinder core (11) and has a radial or diametric guide (39) for the coupling slider (30).

10. Device according to claim 9, wherein the coupling slider (30) consists of a plate with shaped surfaces, the outline (59) of which plate is dimensioned essentially in accordance with the cross section of the housing (13); and wherein the plate (30) has a slot (64), through which the cylinder core (11) or its axial extension (23) passes in the axial direction.

11. Device according to claim 1, wherein a radial bore (53) in the freewheel sleeve (12) holds a retaining element (60) with freedom of radial movement; wherein a recess (62) and opposing recesses (61; 63) are provided in the cylinder core (11) and in the housing (13), into which the inner or radially outer end of the retaining element (60) can alternately fit; and in that the retaining element (60) and the recesses (61–63) belong to a positive control system, which either holds the cylinder core in position with respect to the sleeve or the sleeve in position with respect to the housing.

12. Device according to claim 11, wherein, after an overload case (56) and the subsequent turning of the key, the retaining element (60) and its associated recesses ensure the automatic synchronization of the cylinder core (11) in the housing (13), as a result of which the core arrives at one of the starting key withdrawal positions.

13. Device according to claim 1, wherein each locking control element consists of a roller (21; 22); and wherein the axial connection between the locking control element and the coupling slider is formed by an axial shoulder (35; 36) on the roller (21, 22).

14. Device according to claim 11, wherein the retaining element (60) is a ball.

15. Device according to claim 1, wherein the working element (40) is a gear wheel rotatably supported concentrically to the axis of the key (14).

16. Device according to claim 1, wherein two key withdrawal positions (45, 46) are provided, which are arranged essentially at a right angle to each other.

17. Device according to claim 1, wherein the restoring force (33; 33') acts on the coupling slider (30) via the axial connection (35; 36).

* * * * *